US005974809A

United States Patent [19]

Wooster et al.

[11] Patent Number: 5,974,809

[45] Date of Patent: Nov. 2, 1999

[54] CRYOPUMP WITH AN EXHAUST FILTER

[75] Inventors: Gary Wooster, Pinehurst; Frank Skuncik, Norwood; Michael Richardson, Franklin; Richard Mazzola, Ashland; Douglas Funsch, Mansfield; Harry Ledgard, Leominster, all of Mass.

[73] Assignee: Helix Technology Corporation, Mansfield, Mass.

[21] Appl. No.: 09/010,403

[22] Filed: Jan. 21, 1998

[51] Int. Cl.[6] ..... B01D 8/00

[52] U.S. Cl. ..... 62/55.5; 417/901; 137/549

[58] Field of Search ..... 62/55.5; 137/549; 417/901

[56] References Cited

U.S. PATENT DOCUMENTS

| | | | |
|---|---|---|---|
| 4,655,046 | 4/1987 | Eacobacci et al. | 62/55.5 |
| 4,697,617 | 10/1987 | Bourke et al. | 137/549 |
| 4,719,938 | 1/1988 | Pandorf | 137/244 |
| 4,834,136 | 5/1989 | Bourke et al. | 137/549 |
| 5,137,050 | 8/1992 | Clarke et al. | 137/541 |
| 5,211,022 | 5/1993 | Bartlett et al. | 62/55.5 |
| 5,228,299 | 7/1993 | Harrington et al. | 62/55.5 |
| 5,333,466 | 8/1994 | Harrington et al. | 62/55.5 |
| 5,400,604 | 3/1995 | Hafner et al. | 62/55.5 |
| 5,465,584 | 11/1995 | Mattern-Klosson et al. | 62/55.5 |

FOREIGN PATENT DOCUMENTS

| | | |
|---|---|---|
| 0 747 452 | 10/1997 | France . |
| 91 11 236 | 7/1992 | Germany . |
| 87 00586 | 1/1987 | WIPO . |

*Primary Examiner*—Christopher B. Kilner
*Attorney, Agent, or Firm*—Hamilton, Brook, Smith & Reynolds, P.C.

[57] ABSTRACT

A filter standpipe is mounted within a relief conduit of a cryopump. The relief conduit is joined to an exhaust conduit, and the exhaust conduit is joined to a housing which defines a vacuum chamber. The relief conduit and exhaust conduit define passages which are in fluid communication with one another and also with the vacuum chamber. The filter standpipe extends, from where it is mounted in the relief passage into the exhaust passage. A method for installing the filter standpipe includes the steps of removing a relief valve from a mount on the end of the relief conduit, inserting the filter standpipe through the mount, and remounting the relief valve.

26 Claims, 4 Drawing Sheets

CRYOPUMP WITH AN EXHAUST FILTER

BACKGROUND OF THE INVENTION

Cryogenic vacuum pumps (cryopumps) remove gases from a surrounding atmosphere by freezing gas molecules onto low-temperature cryopanels. Many recently-produced cryopumps follow a common design concept. One such cryopump was disclosed in U.S. Pat. No. 4,655,046, issued to Eacobacci and Planchard in 1987. An embodiment of this cryopump is illustrated in FIG. 1. The cryopump includes a housing 12 containing a two-stage cryogenic refrigerator 18 and at least two cryopanels including a primary pumping panel 34 and a radiation shield 44. The housing 12 has a flange 14 mounted to it at its open end.

When used in industry, the flange 14 is mounted to a port on a vessel which defines a work chamber. Through a front opening 16 of the cryopump, gas can travel from the work chamber, into a vacuum chamber defined by the housing 12. Within the vacuum chamber, gases are condensed on each of the cryopanels 34 and 44. The radiation shield 44 generally comprises a housing which is closed except at a frontal array 48 positioned between the primary pumping panel 34 and the chamber to be evacuated. The radiation shield 44 is cooled by a first stage 29 of the refrigerator 18 to a temperature in the range of 60 to 130 K. High-boiling-point gases, such as water vapor, which enter from the work chamber condense upon the frontal array 48, while the remainder of the radiation shield 44 serves primarily to shield the primary pumping panel 34 from radiant heat. The primary pumping panel 34 is typically maintained at 4 to 25 K by a second stage 32 of the refrigerator 18 and is used to condense lower-boiling-point gases which pass through the frontal array 48. The underside of the primary pumping panel 34 is coated with adsorbent charcoal 36 which can remove gases with especially-low boiling points, such as hydrogen. Other panels may, for example, include stacked plates having charcoal on the bottom surfaces of the plates.

The cryogenic refrigerator 18 in this embodiment is a two-stage refrigerator which achieves cooling through a Gifford-McMahon cooling cycle, wherein the refrigerator 18 extracts heat from the cryopanels 34 and 44 as it expands compressed helium gas. The refrigerator 18 is driven by a motor 22 and is supplied with helium through a feed line 24. Processed helium is removed from the refrigerator through a return line 26, which returns the helium to a compressor which recompresses the helium for repeated processing.

The cryopanels establish a vacuum within the vacuum chamber essentially by freezing gas molecules out of the atmosphere. When a free-floating gas molecule impacts a cryopanel, the cryopanel extracts thermal energy from the gas molecule. If enough thermal energy is extracted, the phase of the gas molecule will be transformed from a vapor to a solid condensate on the cryopanel. With the gases thus condensed and/or adsorbed onto the cryopanels, a high vacuum is created within both the vacuum chamber and the work chamber.

Once a high vacuum has been established, work pieces can be moved into and out of the work chamber through partially evacuated load locks. With each opening of the work chamber to a load lock, additional gases enter the work chamber. Those gases are then condensed onto the cryopanels to again evacuate the chamber and provide the necessary low pressures for processing. Over time, the efficiency and pumping capacity of the cryopump drop as the amount of condensate accumulated on the cryopanels increases. Moreover, a danger of damage to work pieces within the work chamber as well as a potential health and safety risk exists due to the potential of power outage or other causes of rapid warming which would cause the condensed gases, which may include hazardous chemicals, to sublimate.

Accordingly, the cryopanels 34 and 44 are periodically subjected to a regeneration procedure in which the cryopanels 34 and 44 are warmed under a controlled schedule to release the condensed gases from the cryopanels. The released gases are removed from the vacuum chamber through an exhaust conduit 58. At the end of the exhaust conduit 58 is a relief valve 60 which controls the flow of gas out of the vacuum chamber. The relief valve 60 can likewise provide an outlet for sublimating gases in the event of an unscheduled shutdown of the cryopump.

A typical relief valve 60 is a pressure-release valve which includes a cap, which, when the valve is closed, is held against an o-ring seal by a spring. If the pressure is sufficient to open the valve, the cap is pushed away from the o-ring seal and the exhausted gases flow past the seal. Absent a filter, debris entrained within the exiting gas stream also flows through the exhaust conduit and will often collect on the o-ring seal and closure cap. This debris includes particles of charcoal from the cryopanel or other debris resulting from processing within the work chamber. The accumulation of debris on the seal and cap prevents the valve from sealing. As a result, leaks into the cryopump develop at the relief valve, providing an undesired load on the cryopump.

In the embodiment illustrated in FIG. 1, a filter standpipe 62 is positioned at the mouth of the exhaust conduit to filter debris entrained within the exiting gas stream. The filter standpipe 62 includes a stainless steel mesh screen formed into a cylinder with an open end 64. The open end precludes a potentially dangerous pressure buildup in the chamber if the filter screen should otherwise become clogged. The filter standpipe 62 is at least about four inches in length and is installed in the cryopump through the front opening 16 either before the cryopanels 34 and 44 are installed or after removing the cryopanels 34 and 44 to provide access to the exhaust conduit 58 from within the vacuum chamber.

DISCLOSURE OF THE INVENTION

Within the past decade, cryopump design has shifted from the vertical, coaxial alignment of the refrigerator and the cryopanels to a horizontal, or flat, alignment of the refrigerator, wherein the refrigerator is aligned along an axis perpendicular to that of the cryopanels. This development has brought a change in the design of the housing. Separate cylinders are now joined together to enclose both the refrigerator and the cryopanels within a vacuum chamber. This design is typically more compact than the coaxial design, and, as a result, space within the housing is more limited. Moreover, the exhaust conduit has been moved to the first-stage shell which is not readily accessible from inside the chamber and which offers very little open space. As a result, filter standpipes have not been used in "flat" cryopumps. Consequently, the seals must be regularly cleaned to maintain the integrity of the vacuum within the chamber.

In accordance with this invention, the cryopump includes an exhaust conduit which defines an exhaust passage joined to the housing. A relief conduit is joined to this exhaust conduit. The relief conduit has a filter standpipe mounted within it, wherein the filter standpipe projects into the exhaust passage.

In a preferred embodiment, the filter standpipe is conical with an open base and an open rim at opposite ends. The open rim is positioned within the exhaust conduit, and the exhaust conduit is oriented along an axis that is at a significant angle, and, preferably, approximately perpendicular to the relief conduit. Further, a rough pump is mounted to the exhaust conduit, and a relief valve including an o-ring is detachably mounted to the relief conduit. Further still, the filter standpipe includes a wire mesh and is sized and shaped to allow it to be fed, without significantly altering its shape, into the relief conduit and into position when the relief valve is detached from the relief conduit. A particularly preferred embodiment of the filter standpipe has dimensions that are established to provide a desired filtering performance when used in conjunction with currently-used tees having fixed dimensions. Specifically, this embodiment has an open rim with a diameter of between about 0.15 inches and about 0.25 inches, a length of between about 2.0 and about 2.4 inches, and a base ring with an outer diameter of about 0.69 inches.

In another preferred embodiment, at least one cryopanel extends along an axis within the vacuum chamber and is in thermal contact with a cryogenic refrigerator which extends along an axis perpendicular to the axis of the cryopanel. Further, the housing includes a first-stage shell to which is joined the exhaust conduit. Further still, the exhaust conduit is joined to an end of the relief conduit.

A method of this invention filters particulates that are entrained within gas released from a cryopump pumping chamber during a regeneration procedure. First, a cryopanel within the pumping chamber is heated to sublimate condensed gas from the cryopanel. The sublimated gas is vented from the pumping chamber into an exhaust conduit. From the exhaust conduit, the sublimated gas is vented to a relief conduit. As the gas flows from the exhaust conduit to the relief conduit, particulates entrained within the sublimated gas are filtered with a filter standpipe mounted within the relief conduit and extending into the exhaust passage. Finally, the sublimated gas is vented from the relief conduit through a relief valve.

Another method of this invention is directed to the installation of a filter standpipe in a cryopump. The vacuum vessel is constructed as describe, above. The filter standpipe is installed by removing a relief valve from a mount on an end of a relief conduit. The filter standpipe is then inserted through the mount into the relief conduit to a position where the filter standpipe extends into the exhaust conduit. The relief valve is then remounted onto the mount.

This invention offers the advantage of providing a highly efficient particulate filter that can be introduced into a challenging space at the junction of the exhaust and relief conduits. Further, the filter standpipe of this invention is easier to install than were the models used in previous cryopump designs. The filter standpipes of this invention can also be easily retrofitted into existing cryopump models. Moreover, the dimensions of the filter standpipe have been selected to provide highly-efficient particle removal along with a low pressure differential across the filter even after substantial particle accumulation. Finally, the filter standpipe of this invention can substantially reduce or eliminate the need to routinely clean an o-ring seal on the relief valve to reestablish a vacuum after regeneration.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily drawn to scale, emphasis instead being placed upon illustrating the principles of the invention.

DETAILED DESCRIPTION OF PREFERRED EMBODIMENT

While this invention has been particularly shown and described with references to preferred embodiments thereof, it will be understood by those skilled in the art that various changes in form and details may be made therein without departing from the scope of the invention as defined by the appended claims.

Figure 1:
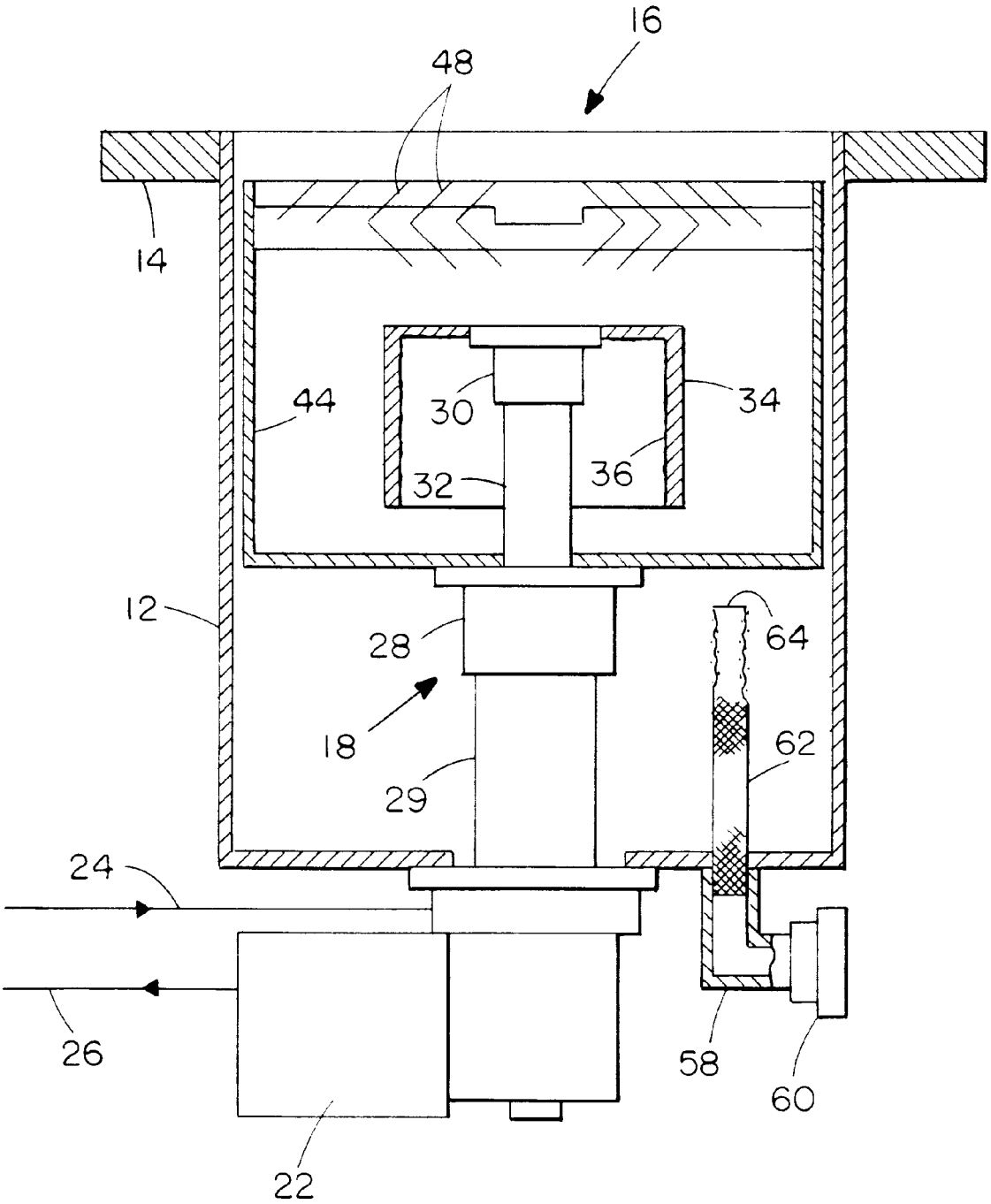
FIG. 1 PRIOR ART
FIG. 1 is a cross-sectional view of a cryopump of the prior art.
Figure 2:
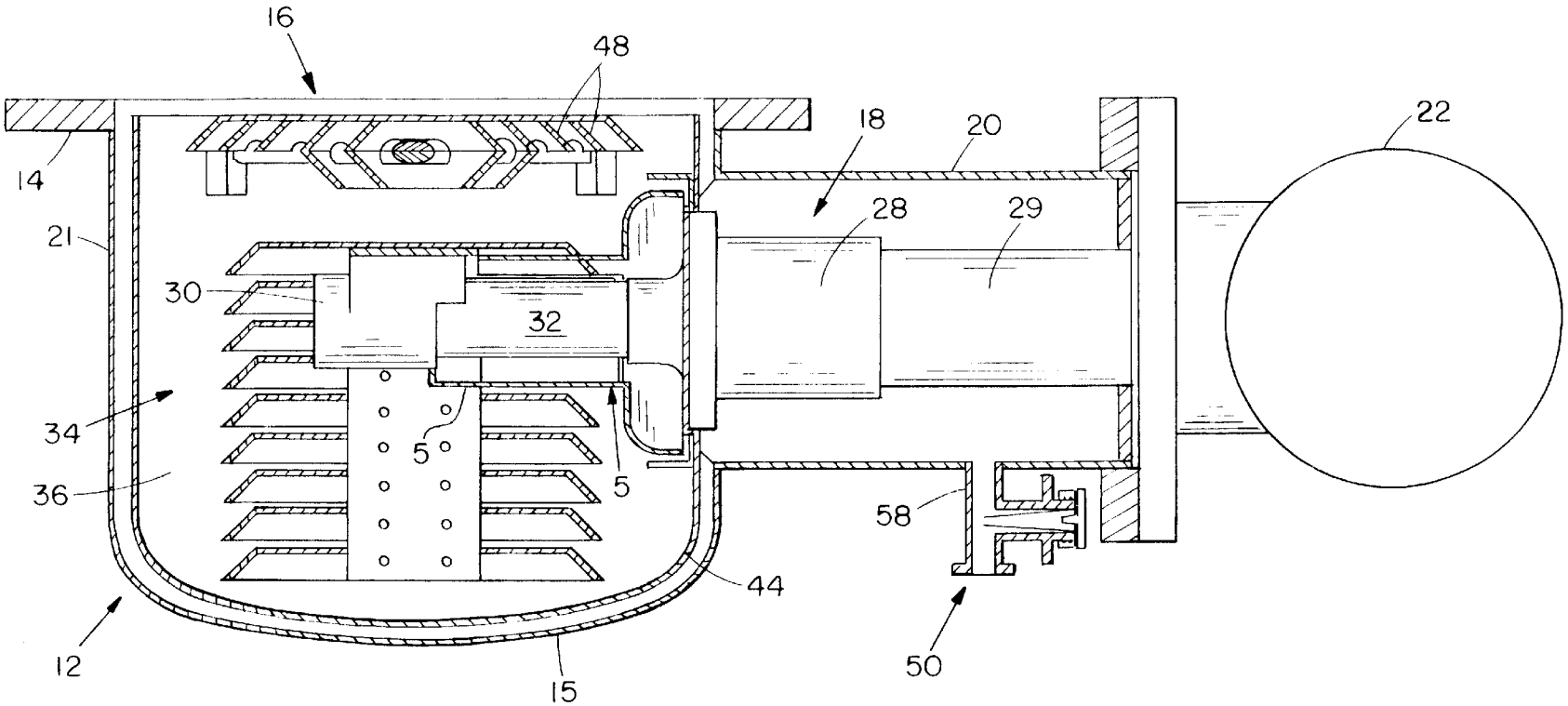
FIG. 2 is a cross-sectional view of a cryopump of this invention.

FIG. 2 illustrates a cryopump of this invention. The cryopump includes a housing 12 which houses the dominant part of a vacuum chamber. The housing 12 includes a first-stage shell 20 and an outer cylinder 21. The outer cylinder 21 includes a closed end 15 and houses the cryopanels 34 and 44, while the first-stage shell 20 houses at least a first stage 29 of a cryogenic refrigerator 18 along with a first-stage heat sink 28. A flange 14 is mounted to the outer cylinder which allows the cryopump to be mated with a port on a work chamber. Often, the cryopump is mounted to the work chamber along a vertical axis, where the outer cylinder 21 is on top with the first-stage shell 20 and the motor 22 positioned beneath. This orientation can be visualized by providing a 90 degrees clockwise rotation to FIG. 2. The vacuum chamber is in fluid communication with the work chamber through a frontal opening 16.

A pair of cryopanels for condensing gases is positioned within the vacuum chamber. The cryopanels include a radiation shield 44 and a primary pumping panel 34. A frontal array 48 of the radiation shield 44 is positioned within the front opening 16 to condense higher-boiling-point gases as they enter from the work chamber. The remainder of the radiation shield 44 extends away from the front opening 16 to define a volume 36 for condensation. Within this volume 36 is a primary pumping panel 34. In this embodiment, the primary pumping panel 34 takes the form of an array of baffles upon which gases can be condensed. The primary pumping panel 34 is mounted to a second stage 32 of a two-stage Gifford-McMahon cryogenic refrigerator 18. A second-stage heat sink provides close thermal contact between the second stage 32 and the primary pumping panel 34. Meanwhile, the radiation shield 44 is mounted to a first stage 29 of the two-stage Gifford-McMahon cryogenic refrigerator 18. A first-stage heat sink 28 provides close thermal contact between the first stage 29 and the radiation shield 44.

Within the refrigerator 18, cooling is achieved by processing a cyclic flow of compressed gas, such as helium, through a refrigeration cylinder. A source of compressed gas, i.e., a compressor, is typically connected to a first end of the cylinder through an inlet valve. An exhaust valve in an exhaust line leads from the first end of the cylinder to the low-pressure side of the compressor. Initially, a displacer including a regenerative heat exchange matrix (regenerator) is at a second end of the cylinder. The exhaust valve is closed, and the inlet valve is open causing the cylinder to fill with compressed gas. With the inlet valve still open, the displacer moves toward the first end to force compressed gas through the regenerator to the second end, the gas being cooled as it passes through the regenerator. When the inlet valve is closed and the exhaust valve opened, the gas expands into the low-pressure exhaust line and cools further. The resulting temperature gradient across the cylinder wall at the second end causes heat to flow from the load (i.e., the cryopanels) into the gas within the cylinder. Then, with the exhaust valve opened and the inlet valve closed, the displacer returns to the second end. The gas is thereby displaced back through the regenerator which returns heat to the cold gas, and the cycle is completed.

To achieve temperatures that are sufficiently cold to condense low-boiling-point gases, such as nitrogen, oxygen and argon, a second stage 32 is added to the refrigerator 18. The second stage 32 intakes helium gas that has already been cooled by the first stage 29 and cools it even further, typically to a temperature between about 4 and 25 K.

The refrigerator 18 extends along an axis perpendicular to the axis about which the radiation shield 44 is substantially symmetrical. The first stage 29 of the refrigerator 18 extends through the first-stage shell 20 to where it is joined to the second stage 32. The second stage 32 projects from the first stage 29 into the pumping region defined by the outer cylinder 21.

An exhaust conduit 58 of a tee 50 is connected to the first-stage shell 20, remote from the cryopanels 34 and 44. The tee 50 is illustrated in greater detail in FIG. 3. The exhaust conduit 58 defines a passage 59 which is in fluid communication with the rest of the vacuum chamber, thereby allowing high pressures within the housing 12 to be vented through the exhaust conduit 58. High pressures often arise when the cryopanels are regenerated, as discussed, below. At the end of the exhaust conduit 58, remote from the housing, is a rough pump for establishing preliminary, low-level vacuums within the vacuum chamber.

An end of a relief conduit 68 is mounted to the exhaust conduit 58. The relief conduit 68 defines a relief passage 69 and is oriented along an axis perpendicular to the axis of the exhaust passage 59. The relief conduit 68 terminates at its opposite end in a mount 70 for a detachable relief valve 60. A filter standpipe 62 is fitted within the mount 70 and a detachable relief valve 60 is threaded onto the mount 70, enclosing the filter standpipe 62 within the relief and exhaust passages 69 and 59. The relief valve 60 includes a cap 72 which, when the valve is closed, is held against an o-ring seal 74 by a spring 76. The spring 76 is biased toward the relief passage 69 by a threaded body 78 with a perforated end plate 80. If the pressure within the passage exceeds 1.5 pound per square inch, the force of the spring 76 is overcome, and the cap 72 is pushed away from the o-ring seal 74 allowing the exhausted gases to flow past the seal 74.

Figure 4:
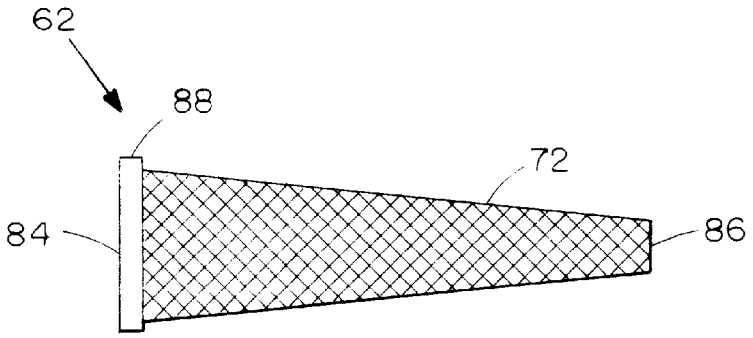
FIG. 4 is a side view of a filter standpipe.
Figure 5:
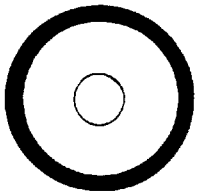
FIG. 5 is a side view of the wire mesh of the filter standpipe.
Figure 6:
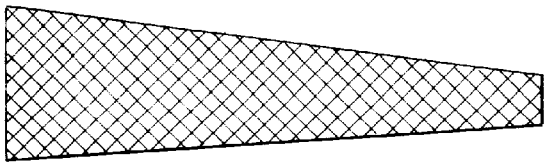
FIG. 6 is a side view of the base ring of the filter standpipe.

The filter standpipe 62 is illustrated in FIG. 4. It comprises a conical screen 72 of metal wire having a diameter of 0.0055 inch in the form of an 80×80 mesh plain weave. The opening at the base 84 is 0.62 inches and the diameter of the open rim 86 at the narrow end is preferably between 0.15 and 0.25 inches. A diameter of at least 0.15 inches is needed to permit passage of liquid cryogens which may pass through the tee. In a particularly preferred embodiment, the diameter of the open rim 86 is between about 0.18 inches and 0.22 inches.

Figure 3:
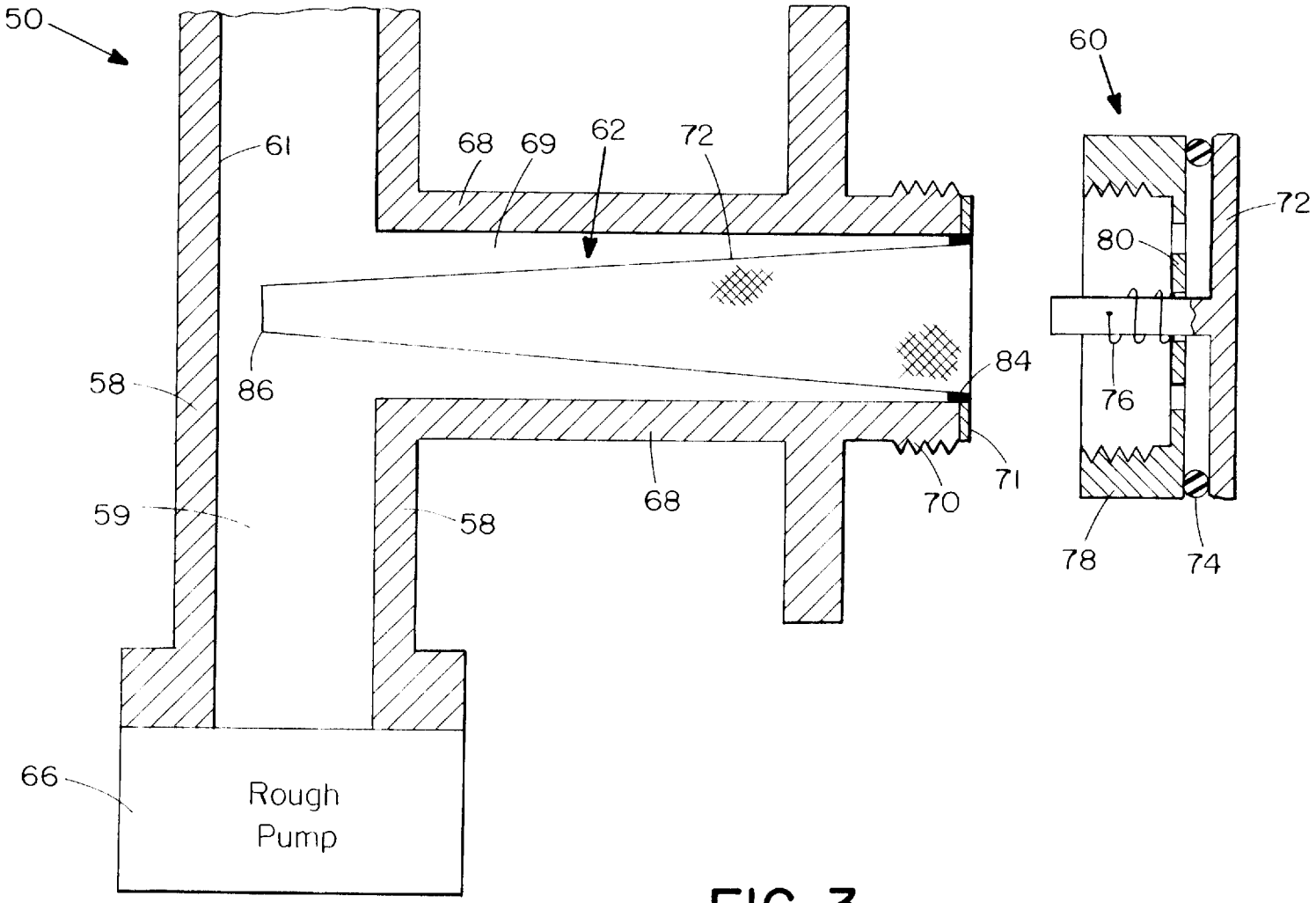
FIG. 3 is a cross-sectional view, partially in schematic form, of a tee including a filter standpipe.

As shown in FIG. 3, the length of the tee 50, along the axis of the relief conduit 68 from the far edge 71 of the mount 70 to the far interior wall 61 of the exhaust conduit 58, is between 2.30 and 2.46 inches. The scope of this range is due to manufacturing tolerances. The remote edge of the base 84 of the filter standpipe 62 is flush with the edge 71 of the mount 70. Accordingly, the gap between the open rim 86 of the standpipe 62 and the far interior wall 61 of the exhaust conduit 58 is the difference between the length of the tee 50 and the length of the standpipe 62.

The length of the filter standpipe 62, measured along the axis of substantial symmetry from the end of the base 84 to the open rim 86, is preferably between about 2.0 and about 2.3 inches to place the open rim 86 within the exhaust passage when the filter 62 is installed in the tee, described above. More preferably, the filter standpipe 62 will have a length that is about 0.21 inches shorter than the length of the tee to provide a corresponding gap of 0.21 inches between the open rim 86 and an opposing wall of the exhaust conduit. In a particularly preferred embodiment, the length of the filter standpipe is between 2.14 and 2.20 inches. Due to manufacturing tolerances in the dimensions of the filter standpipe, the filter standpipe is expected to have a tolerance of 0.03 inches, which accounts for the variance of 0.03 inches from a target length of 2.17 inches in the previous embodiment. A length of 2.17 inches will provide the desired gap of 0.21 inches in an average tee having a length of 2.38 inches. Because the trajectory of fluid and particle flow from the exhaust conduit into the relief conduit is substantially perpendicular to the metal mesh screen 62, a filter standpipe with a preferred length of about 2.17 inches and an open rim with a preferred diameter of about 0.18 inches will allow very few, if any, particles to escape entrapment in a standard tee, described above. Further, even a filter standpipe 62 with an open rim diameter of 0.22 inches and a length that provides a gap of 0.32 inches between the open rim 86 and the interior wall 61 of the tee is expected to capture more than 90% of incoming particles. On the other hand, as the size of the gap or the open rim 86 decreases, the pressure differential across the filter standpipe 62 increases. Moreover, the pressure differential also increases when the screen 72 is substantially clogged with trapped particles. The existence, as well as the size and positioning, of the opening defined by the open rim 86 is important because it provides an open passage for gas flow even when the entire surface of the metal screen 72 is clogged with particles. If the entire screen 72 were to clog without a sufficient outlet, such as that provided by the open rim 86, the pressure would build within the vacuum chamber to a level where the equipment could be damaged. Most likely, a gate valve at the front opening of the cryopump would be the first to fail as a result of a pressure overload within the chamber. Embodiments with dimensions within the above-stated ranges will not produce a pressure differential exceeding acceptable limits, i.e., a pressure differential of greater than 25 pounds per square inch, even when the screen 72 is substantially clogged with particles.

Equally important, the opening defined by the open rim 86 serves as an outlet for liquid cryogen draining from the pumping region. As noted, above, the cryopump illustrated in FIG. 2 is often mounted with the outer cylinder 12 at the top of a vertical axis and the motor 22 at the bottom. When the cryopanels are warmed, some of the condensed gases may liquefy, rather than sublimate. The resulting liquid will typically drain from the pumping region defined by the outer cylinder 12 down into the volume defined by the first-stage shell 20. Because the dimensions of the housing 12 are tightly controlled to minimize open space within the vacuum chamber, the first-stage shell 20 can quickly fill with liquid cryogen. Consequently, the liquid cryogen will drain from the first-stage shell through the tee 50, illustrated in FIG. 3. If the pressure within the vacuum chamber is great enough to trigger the relief valve 60, the liquid cryogen will be directed from the exhaust passage 59 into the relief passage 69. The liquid cryogen, however, typically will not be able to penetrate the metal screen 72. Accordingly, the opening defined by the open rim 68 provides a very important passageway for the liquid cryogen so as to prevent the liquid cryogen from clogging the tee 50 and thereby blocking the flow of both liquid and gas out of the housing 12. After passing through the open rim 86 of the filter standpipe 62, the liquid cryogen flows through the relief valve 60 and into another conduit where it can be collected and removed.

The filter standpipe 62 can be easily retrofitted in existing cryopumps which include a detachable relief valve 60 mounted to a relief conduit extending from an exhaust conduit 58. One need only detach the relief valve 60, typically by unscrewing it, from the relief conduit 68. The filter standpipe 62 is then inserted, with the open rim 86 entering first, into the relief passage 69. When fully inserted, the base ring 84 presses against the interior wall of the relief conduit 68, thereby securing the filter standpipe 62 in place. Installation is completed by reattaching the relief valve 60, thereby enclosing the filter standpipe 62 within the vacuum chamber.

As noted, above, the principal stimulus of pressure build up and particulate release within the vacuum chamber is the regeneration procedure. When a regeneration procedure is performed, the cryopanels are warmed causing condensed gases to sublimate from the cryopanels. As gases are released, the pressure in the vacuum chamber increases until the relief valve is forced open, venting the released gases from the chamber. Toward the end of the regeneration, the pressure within the chamber drops below one pound per square inch, and the relief valve closes. The rough pump, which is attached to the exhaust conduit, is then switched on to further reduce the pressure within the chamber before recooling the cryopanels.

EXPERIMENTAL

In a preliminary test, a baseline was established by passing a particle-laden gas stream through the exhaust conduit and through the relief conduit without a filter. An average of 426 particles passed through the relief passage 69. The test was then repeated with a filter standpipe 62 having an opening with a 0.2202 inch diameter and a length of 2.074 inches in a tee 50 with a length of 2.394 inches. An average of 2.3% of the baseline particles passed through the filter 62. The test was again repeated using a filter standpipe 62 having an opening with a 0.180 inch diameter and a length of 2.037 inches in a tee 50 with a length of 2.357 inches. When using this filter 62 an average of 1.0% of the baseline particles passed through the filter 62. The length of the filter standpipe used in these tests was set to provide a gap size of 0.32 inches, which is the maximum within the range of gap sizes (0.10 to 0.32 inches) that is thought to be acceptable in this embodiment. Longer filters, which produce smaller gaps, would be expected to capture more, if not all, of the particles entering from the exhaust passage.

While this invention has been particularly shown and described with references to preferred embodiments thereof, it will be understood by those skilled in the art that various changes in form and details may be made therein without departing from the scope of the invention as defined by the appended claims.

The invention claimed is:

1. A cryopump comprising:

a vacuum vessel having a housing, an exhaust conduit joined to the housing, and a relief conduit joined to the exhaust conduit, wherein the vacuum vessel defines a vacuum chamber, and wherein the housing defines a pumping region within the vacuum chamber, the exhaust conduit defines an exhaust passage within the vacuum chamber, and the relief conduit defines a relief passage within the vacuum chamber;

a filter standpipe mounted within the relief conduit and extending into the exhaust passage;

at least one cryopanel positioned within the pumping region; and a cryogenic refrigerator in thermal contact with the cryopanel.

2. The cryopump of claim 1, wherein the relief conduit joins the exhaust conduit at a significant angle, and wherein the filter standpipe has an open rim positioned within the exhaust passage.

3. The cryopump of claim 2, wherein the filter standpipe is conical in shape.

4. The cryopump of claim 3, wherein the filter standpipe has an open base opposite the open rim, and wherein the open base defines a large circular opening and the open rim defines a small circular opening.

5. The cryopump of claim 4, wherein the filter standpipe comprises a wire mesh.

6. The cryopump of claim 1, wherein the relief conduit terminates where it joins the exhaust conduit.

7. The cryopump of claim 6, wherein the exhaust conduit extends along an axis and the filter standpipe extends along a second axis approximately perpendicular to the axis of the exhaust conduit.

8. The cryopump of claim 7, wherein a relief valve is mounted to the relief conduit.

9. The cryopump of claim 8, wherein the filter standpipe is sized and shaped to be fed, without significantly altering its shape, into the relief conduit and into position when the relief valve is detached from the relief conduit.

10. The cryopump of claim 9, wherein the relief valve includes an o-ring.

11. The cryopump of claim 10, wherein a rough pump is mounted to the exhaust conduit.

12. The cryopump of claim 1, wherein the cryopanel extends along a primary axis, and wherein the cryogenic refrigerator extends along an axis perpendicular to the primary axis.

13. The cryopump of claim 12, wherein the housing includes a first-stage shell and the exhaust conduit is joined to the first-stage shell.

14. A cryopump comprising:

a vacuum vessel having a housing, an exhaust conduit joined to the housing, and a relief conduit joined to the exhaust conduit, wherein the vacuum vessel defines a vacuum chamber, and wherein the housing includes an outer cylinder and a first-stage shell, and wherein the outer cylinder extends along a primary axis and defines a pumping region, and the first-stage shell is joined to the outer cylinder and extends from the outer cylinder along an axis perpendicular to the primary axis;

a radiation shield and a primary pumping panel positioned within the pumping region;

a cryogenic refrigerator having a first stage and a second stage, wherein the first stage is thermally coupled with the radiation shield and the second stage is thermally coupled with the primary pumping panel, and wherein the refrigerator extends through the first-stage shell into the pumping region;

an exhaust conduit joined to the first-stage shell, wherein the exhaust conduit defines an exhaust passage extending along an axis within the vacuum chamber;

a relief conduit joined to the exhaust conduit, wherein the relief conduit defines a relief passage, and wherein the relief passage extends within the vacuum chamber along a second axis perpendicular to the axis of the exhaust passage; and a filter standpipe mounted within the relief conduit, wherein the filter standpipe extends into the exhaust passage.

15. The cryopump of claim 14, wherein the filter standpipe comprises a conically-shaped wire mesh having an open base and an open rim opposite from the open base, and wherein the open base defines a large circular opening and the open rim defines a small circular opening, and further wherein the open rim is positioned within the exhaust passage.

16. A tee comprising:

an exhaust conduit extending along an axis and defining an exhaust passage;

a relief conduit extending along a second axis approximately perpendicular to the axis of the exhaust conduit, wherein the relief conduit has an adjacent end joined to the exhaust conduit and an opposite end, and wherein the relief conduit defines a passage in fluid communication with the exhaust passage; and a filter standpipe mounted within the relief conduit, wherein the filter standpipe extends through the relief conduit and into the exhaust passage.

17. The tee of claim 16, wherein the filter standpipe is sized and shaped to be fed, without significantly altering its shape, into the opposite end of the relief conduit and into position.

18. The tee of claim 17, further comprising a relief valve mounted to the opposite end of the relief conduit.

19. The tee of claim 18, wherein the filter standpipe is conically-shaped having an open base and an open rim opposite from the open base, and wherein the open base defines a large cylindrical opening and the open rim defines a small cylindrical opening, and further wherein the open rim is positioned within the exhaust passage.

20. The tee of claim 19, wherein the filter standpipe includes a wire mesh.

21. A conically-shaped filter standpipe comprising an open rim, an open base, and a base ring attached to the open base, wherein the open rim is opposite from the open base and has a diameter of between about 0.15 inches and about 0.25 inches, the filter standpipe extending between about 2.0 inches and about 2.3 inches along an axis of substantial symmetry, and wherein the base ring has an outer diameter of about 0.69 inches.

22. The conically-shaped filter standpipe of claim 21, wherein the filter standpipe comprises a wire mesh.

23. A method for filtering particulates from gases released from a cryopump pumping chamber during regeneration comprising the steps of:

heating a cryopanel within the pumping chamber to sublimate condensed gas from the cryopanel;

venting the sublimated gas from the pumping chamber into an exhaust conduit;

venting the sublimated gas from the exhaust conduit into a relief conduit;

filtering particulates entrained within the sublimated gas with a filter standpipe mounted within the relief conduit and extending into the exhaust passage; and venting the sublimated gas from the relief conduit through a relief valve.

24. The method of claim 23, wherein the sublimated gas is vented from the exhaust conduit to a relief conduit which joins the exhaust conduit at a significant angle, and wherein the particulates entrained within the sublimated gas are filtered with a filter standpipe having an open rim positioned within the exhaust passage.

25. A method for installing a filter standpipe comprising the steps of:

removing a relief valve from a mount on the end of a relief conduit which joins, at a significant angle, an exhaust conduit, wherein the exhaust conduit joins a cryopump housing;

inserting a filter standpipe through the mount into the relief conduit to a position where the filter standpipe extends into the exhaust conduit; and remounting the relief valve onto the mount on the end of the relief conduit.

26. The method of claim 25, wherein an open rim of the filter standpipe is inserted through the mount, followed by an open base of the filter standpipe such that the open rim is inserted through the relief conduit and into the exhaust conduit.

* * * * *